United States Patent [19]

Harreither

[11] Patent Number: 4,744,503

[45] Date of Patent: May 17, 1988

[54] PROCESS AND APPARATUS FOR TENSIONING AN ENDLESS THIN METAL SHELL ON A WHEEL, ROLL OR DRUM

[75] Inventor: Rupert Harreither, Baden, Austria

[73] Assignee: Austria Metall Aktiengesellschaft, Braunau am Inn, Austria

[21] Appl. No.: 852,253

[22] Filed: Apr. 15, 1986

[30] Foreign Application Priority Data

Apr. 15, 1985 [AT] Austria ..... 1116/85

[51] Int. Cl.[4] ..... B23K 31/00

[52] U.S. Cl. ..... 228/125; 228/47; 228/212; 72/292

[58] Field of Search ..... 228/125, 212, 213, 152, 228/47, 48; 29/428, 559, DIG. 48; 72/303, 292, 302, 392

[56] References Cited

U.S. PATENT DOCUMENTS

| | | | |
|---|---|---|---|
| 148,385 | 3/1874 | Schon | 72/303 |
| 791,693 | 6/1905 | House | 72/303 |
| 890,587 | 6/1908 | Markham | 72/303 |
| 3,732,614 | 5/1973 | Boutell | 228/212 |
| 3,978,704 | 9/1976 | Fridman et al. | 72/303 |
| 4,121,747 | 10/1978 | McFatter | 228/47 |
| 4,576,327 | 3/1986 | Kahilathi et al. | 228/212 |

*Primary Examiner*—M. Jordan

*Attorney, Agent, or Firm*—Karl F. Ross; Herbert Dubno

[57] ABSTRACT

The process comprises unrolling a metal band onto the circumference of a drum, pressing the metal band continuously onto the drum until the metal band surrounds the drum and the ends of the metal band overlap, clamping the metal band to the drum with a plurality of clamping members or a clamping belt, heating the metal band and drum, and in this condition cutting the metal band to length for welding, and working, welding and finishing the ends and edges of the metal band to form a smooth surface on the circumference of the drum. The apparatus for performing the process of the invention comprises a pivotal support for mounting the drum rotatably on a horizontal axis, a groove in the circumference of the drum at the position where the welding occurs, a rail, preferably copper, with a recess for release of a cutting tool and for a weld seam held in the groove, a plurality of pairs of clamping members mounted on a shoulder rim of the drum attachable by screws to the band, and a clamping mechanism connected between each of the clamping members of the pairs of clamping members to provide longitudinal tension to the metal band. As an alternative to the clamping members and the clamping mechanism the apparatus is provided with a clamping belt and a clamping frame to clamp the metal band to the drum.

20 Claims, 16 Drawing Sheets

PROCESS AND APPARATUS FOR TENSIONING AN ENDLESS THIN METAL SHELL ON A WHEEL, ROLL OR DRUM

FIELD OF THE INVENTION

My present invention relates to a process and apparatus for tensioning a thin metal shell on a drum, roll, wheel or the like and, more particularly, to a process and apparatus for covering the circumference of a roll with a thin mirror finished endless metal covering, e.g. for continuous film casting.

BACKGROUND OF THE INVENTION

In film casting, a composition of film-forming agents in a volatile solvent is cast in a thin layer onto a surface, the solvent is permitted to evaporate and the film, e.g. a photograhpic film base, is peeled or shaved from the surface.

Particularly in a film casting machine the very large casting roll, wheel or drum has a surface which is of a high quality material which needs frequent refinishing, while the drum itself is composed of cast iron.

The metal covering wall or shell providing this surface over the circumference of the drum must be clamped very tautly onto the drum.

Because of the size of the drum and the bulkiness of its structure the metal band forming the shell must be mounted on the spot and the otherwise common process of thermally shrinking the band onto the roll cannot be used to make the shell.

OBJECTS OF THE INVENTION

It is an object of my invention to provide an improved process and apparatus for providing a cylindrical metal drum with a thin metal covering wall under tension.

It is also an object of my invention to provide a process and apparatus for applying and attaching a thin wall of high quality mirror finished metal to the outer periphery of a cylindrical drum which is too large for conventional mounting processes such as heat shrinking.

Another object is to provide an improved method of applying a highly polished thin metal shell to the drum of a film casting machine.

SUMMARY OF THE INVENTION

These objects and others which will be made more apparent hereinafter are attained in a process and apparatus for covering the circumference of a cylindrical metal drum with a thin metal shell.

According to my invention this process comprises unrolling a metal band onto the circumference of the drum and pressing the metal band continuously onto the drum until the metal band surrounds the drum and the ends of the metal band overlap, clamping the metal band to the drum, cutting the metal band to length for welding on the drum, and working, welding and finishing the metal strip.

According to a further feature of my invention the metal band which is unrolled onto the drum is clamped to each edge of the circumference of the drum continuously or intermittently with clamping members until the ends of the metal band overlap, then proceeding from the side opposite the overlap to tension the band by pushing apart pairs of clamping plates or, more generally clamped are attached stepwise to the drum and the metal band and are pushed from each other by a clamping mechanism mounted between each of the pairs of clamping plates. The portion of the metal band lying between each pair of clamping plates is brought under a predetermined tension force stepwise until the overlap is reached, and then the ends of the metal band which overlap are cut through and the cut ends are finished. After clamping to close the gap formed between the ends of the metal band, the ends are welded together and the joint is subsequently finished.

Alternatively in another embodiment of the process of my invention a clamping belt is unrolled with the metal strip, wrapped around the metal band on the drum under tension, and clamps the metal band to the drum by friction.

The apparatus for performing the process of our invention comprises a pivotal support for mounting the drum rotatably on a horizontal axis, a groove in the drum at the position where the welding occurs, a rail with a recess for passage of a cutting tool and for a weld seam held in the groove, a plurality of pairs of clamping members mounted on a shoulder rim of the drum attachable by screws to the drum and the strip, and a clamping mechanism connected between the pairs of clamping members to provide longitudinal tension to the metal strip. According to further features of my invention the rail projects above the circumference of the drum to allow working of the weld bead of the weld seam and the rail with the recess for the weld seam to provide a smooth surface and flush with the surrounding surfaces of the metal strip.

The position where the ends of the metal band overlap is advantageously positioned at the bottom of the drum and before tensioning of the clamps the ends of the metal band are freed.

Furthermore the clamping mechanism may be hydraulic and after operation of this clamping mechanism it can be replaced by a screw shackle member.

The clamping tensioning may advantageously be conducted stepwise alternating between both sides of the drum. The ends of the metal band are positioned at the top of the drum during the working and the welding. A follow up tensioning applied to the ends is effected after the cutting and both the main tensioning and/or follow up tensioning are conducted at a temperature elevated above ambient temperature, preferably the temperature at which the drum is to be used. The welding can occur by a TIG (Tungsten-inert gas) process with an electric motor driven torch guide member.

Of course the process also includes removing the clamping members and the clamping plates and trimming the edges of the metal strip.

In the embodiment of the process according to my invention in which clamping the metal band occurs using a clamping belt the tensioning force is provided by a clamping frame which simultaneously can act as a support for a clamping member and a tool such as a cutter, a grinder, a welding torch or the like.

The metal band can also be pressed by a roller to the drum.

A crank drive the drum provides the motion required of the drum during grinding of the weld seam.

BRIEF DESCRIPTION OF THE DRAWING

The above and other objects, features and advantages of my invention will become more readily apparent from the following description, reference being made to the accompanying highly diagrammatic drawing in which:

FIG. 7 is a cutaway side elevational view showing a part of the apparatus of FIG. 1 in operation during the cutting of the metal shell to fit the drum, drum or the like;

SPECIFIC DESCRIPTION

Figure 1:
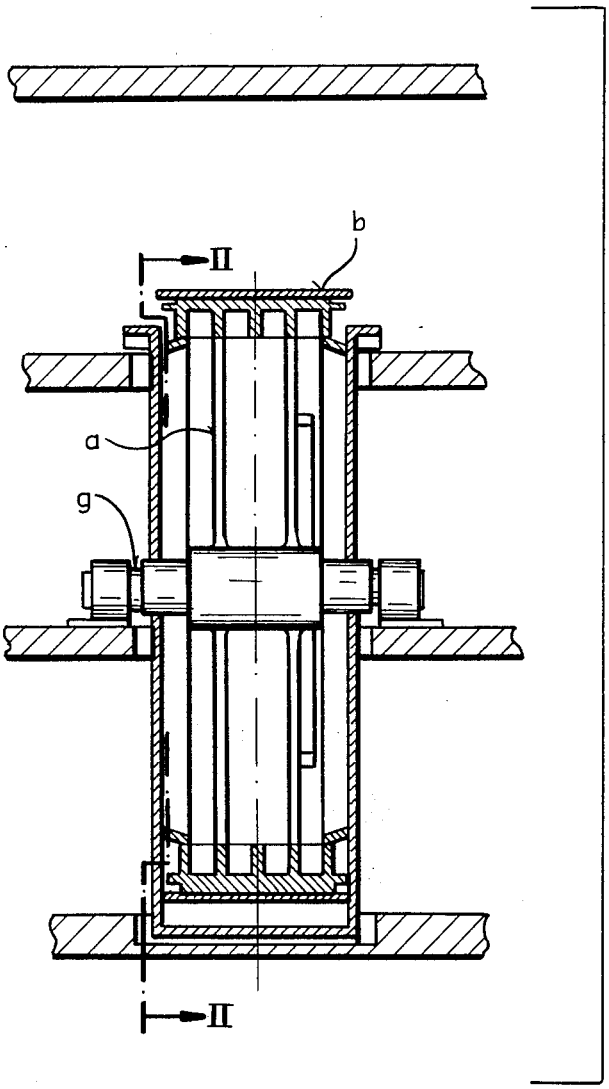
FIG. 1 is a vertical cross sectional view of an apparatus for covering the circumference of a drum with a thin metal shell according to my invention, taken along the section line I—I of FIG. 2.

The apparatus and process of my invention shown in the drawing covers the outer periphery of a film-casting drum of a diameter of 4.8 m for photographic film manufacture, with a 1 mm thick, 1.2 m wide high quality steel band b which acts as a shell with a mirror finished surface required for the error free casting of clear triacetate film base.

Figure 7:
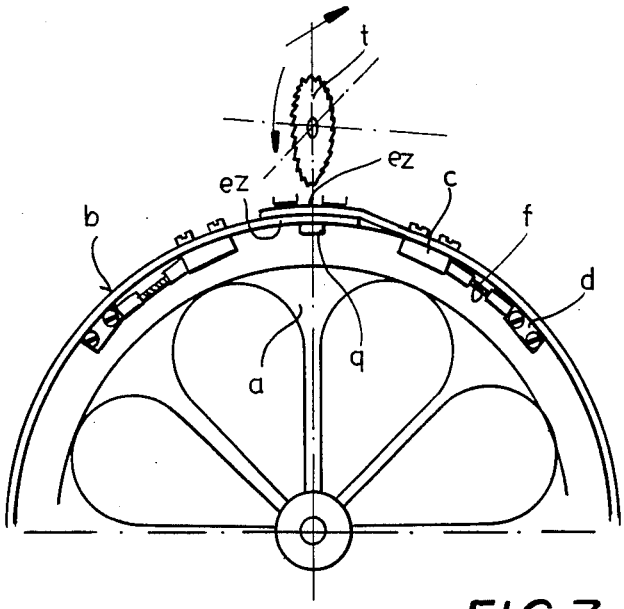
Figure 10:
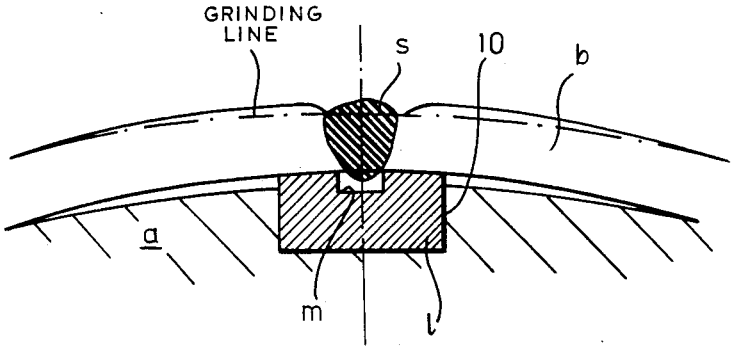
FIG. 10 is a side view showing the weld seam in the apparatus of FIG. 1.

For receiving a rail 1, preferably from copper, for continuously welding of the cut ends of the metal band b a groove g about 10–12 mm deep and 40 mm wide is cut into the drum A (FIGS. 7 and 10). In cases where the welding parameters (weld material flow) do not require it the groove g is omitted.

Figure 11:
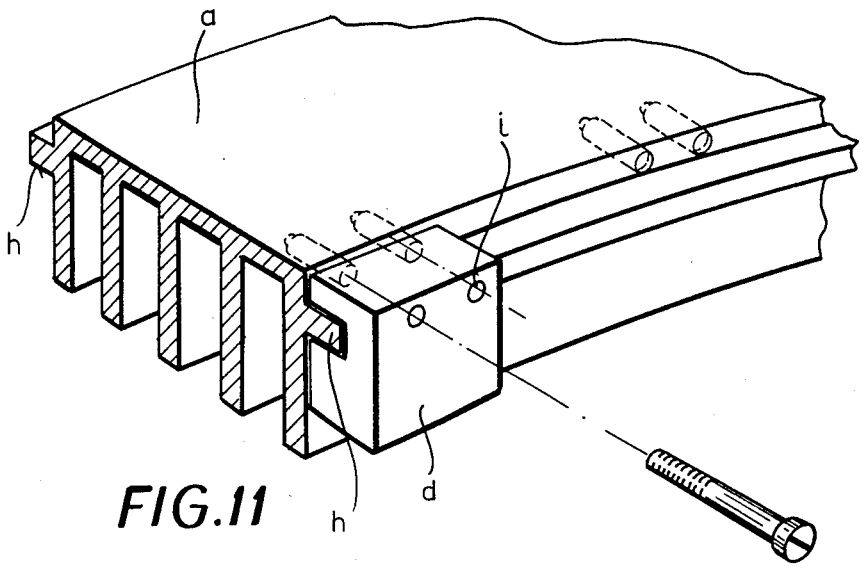
FIGS. 11 and 12 are magnified schematic cutaway perspective views of a portion of the band of FIG. 1 showing how the clamping members are mounted.

For attachment of the clamping members d screw holes i are drilled in the axial direction in both lateral surfaces of the drum a above the shoulder h which form the supporting rim (FIG. 11).

The metal band b is about 600 mm longer than the circumference of the drum a. The width of the band b is so selected that it projects about 30 mm beyond the drum a to the left and to the right. The outer surface of the band b facing the exterior, on which the film-forming material is poured, is provided with a suitable protective foil.

Figure 12:
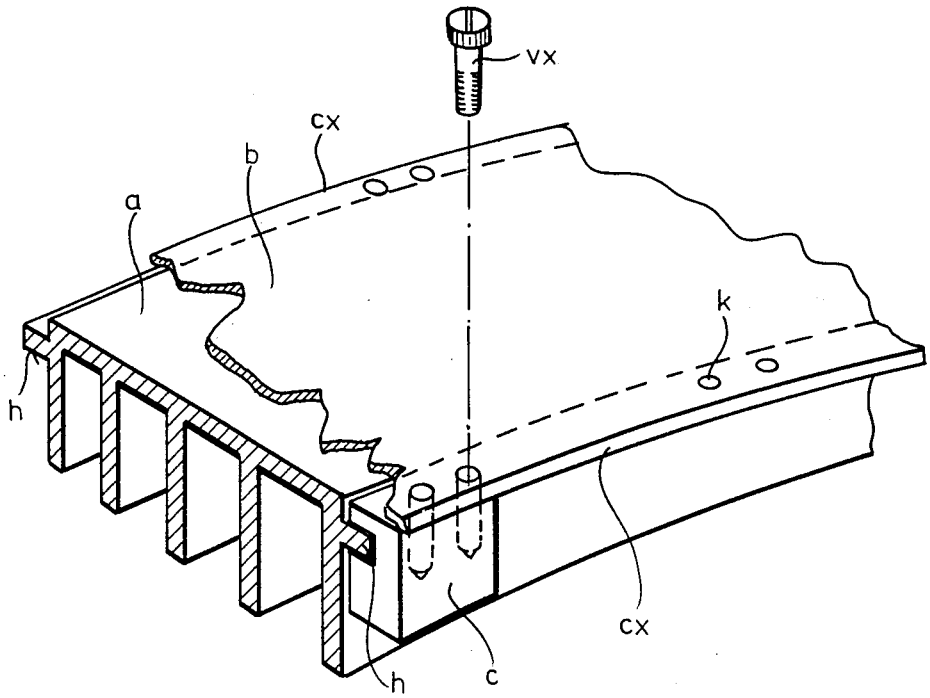
Figure 13:
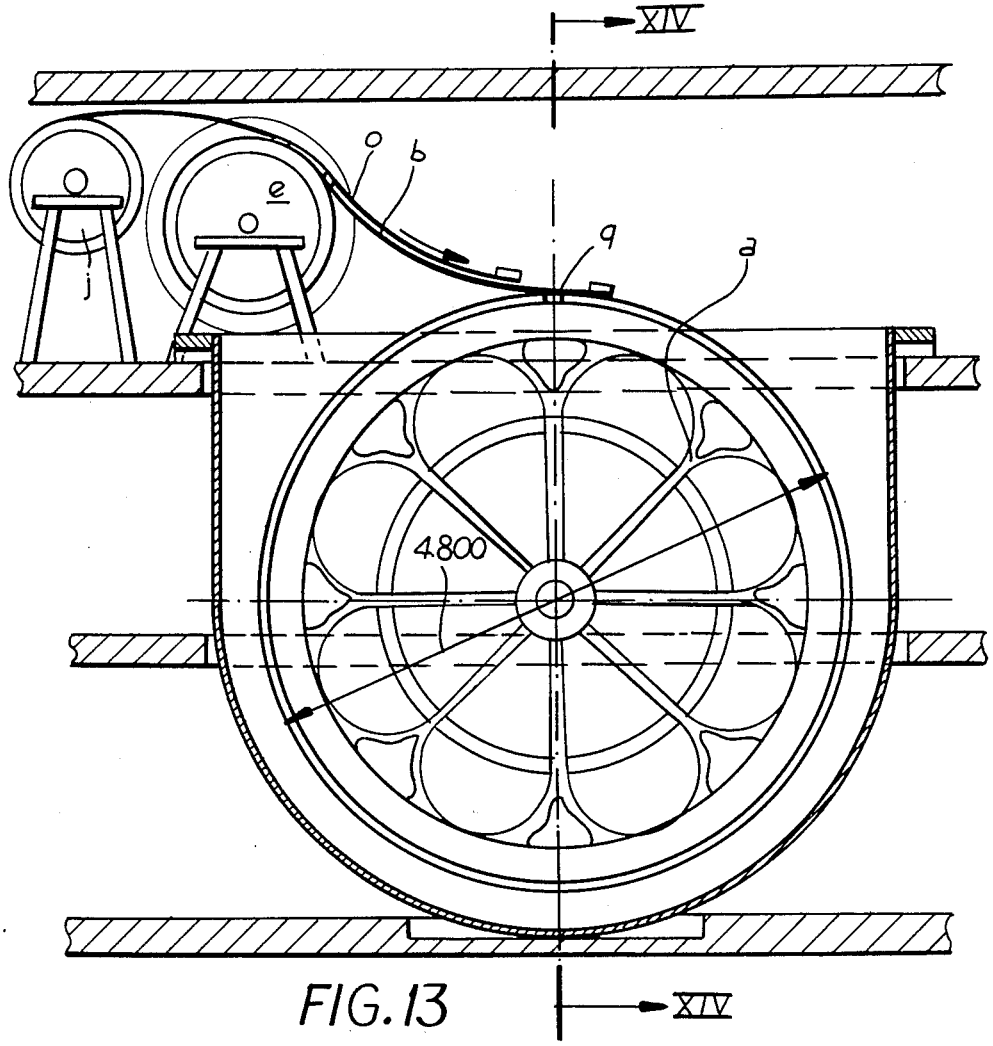
FIG. 13 is a side cross sectional view of an alternative embodiment of an apparatus for covering the periphery of a drum, or the like with a thin metal shell according to my invention in which a clamping belt is used during operation of the apparatus taken along the section line XIII—XIII of FIG. 14.
Figure 15:
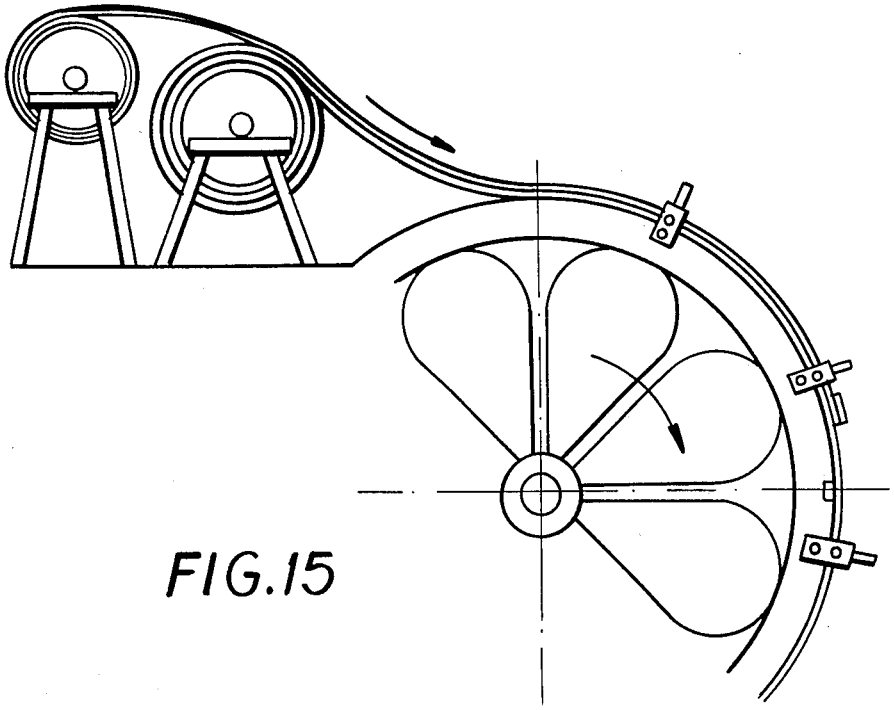
FIG. 15 is a schematic cutaway side view of a part of the apparatus of FIG. 13 in operation with the clamping belt in an intermediate position.
Figure 16:
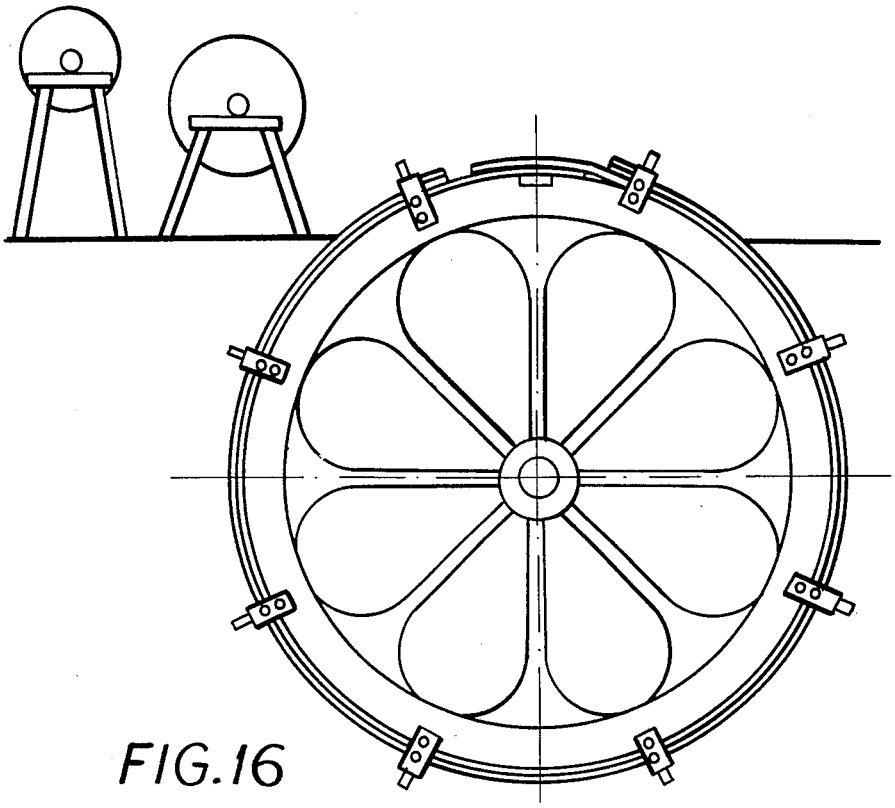
FIG. 16 is a schematic side view of a part of the apparatus of FIG. 13 showing the final configuration with the clamping belt completely around the apparatus.
Figure 17:
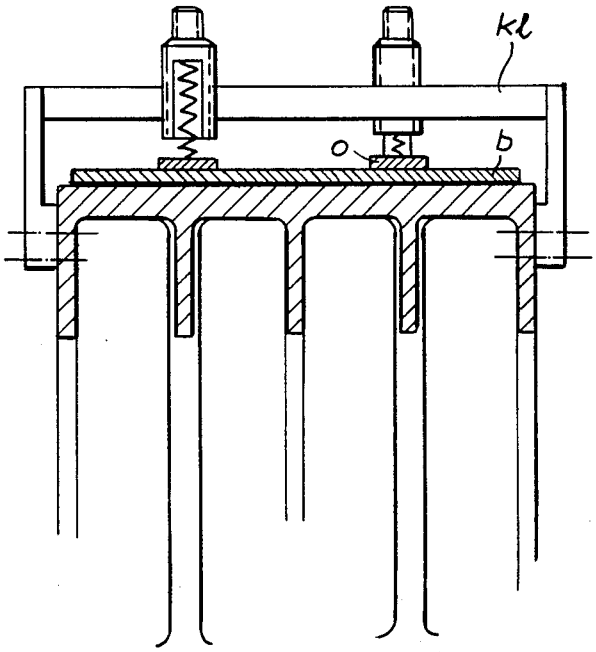
FIG. 17 is a cutaway cross sectional view showing a clamping member of the apparatus of FIG. 13.

The overlying edges of the band b have holes k spaced appropriately for the attachment of clamping members c by screws. These clamping members c are formed so that they can slide along the shoulders h of the drum a(FIG. 12).

Figure 2:
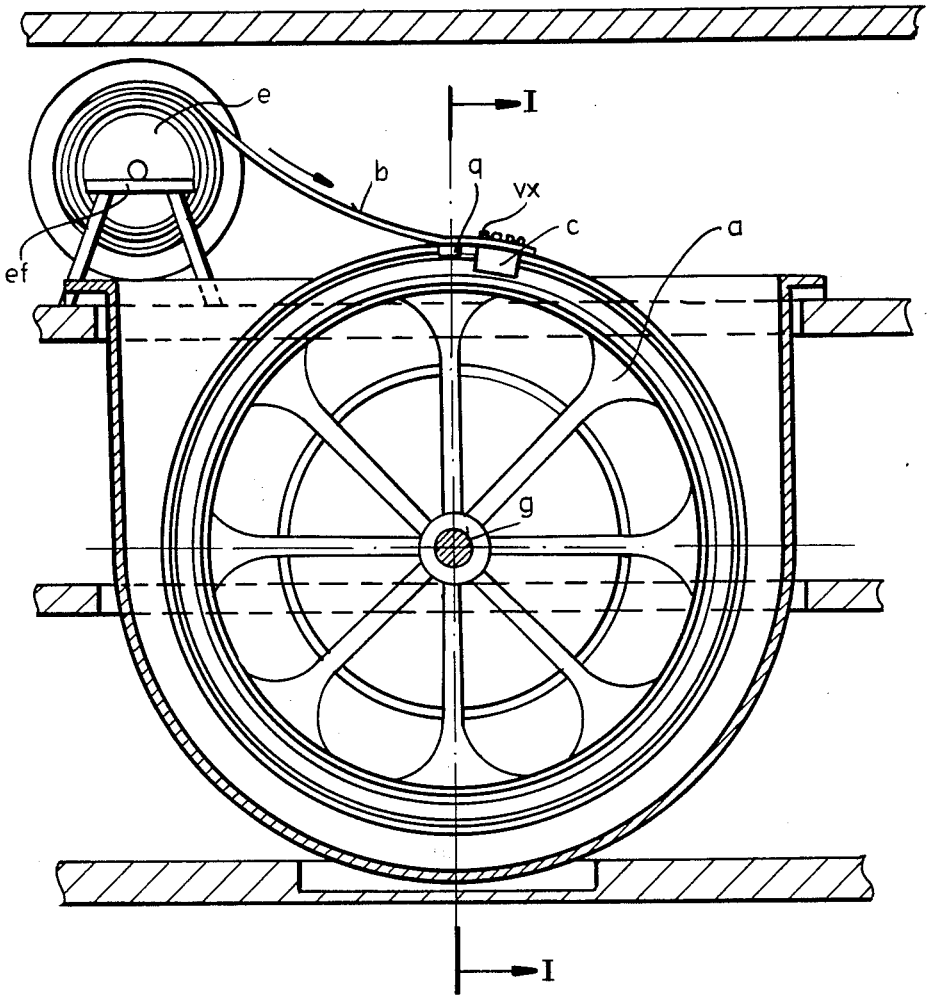
FIG. 2 is a side cross sectional view of the apparatus of FIG. 1 taken along the section line II—II of FIG. 1.

The metal band b wound on a travelling spool e is mounted on a pivotal support ef of an uncoiling frame and the end of the band b is attached to the drum a with a clamp (FIG.2).

Figure 3:
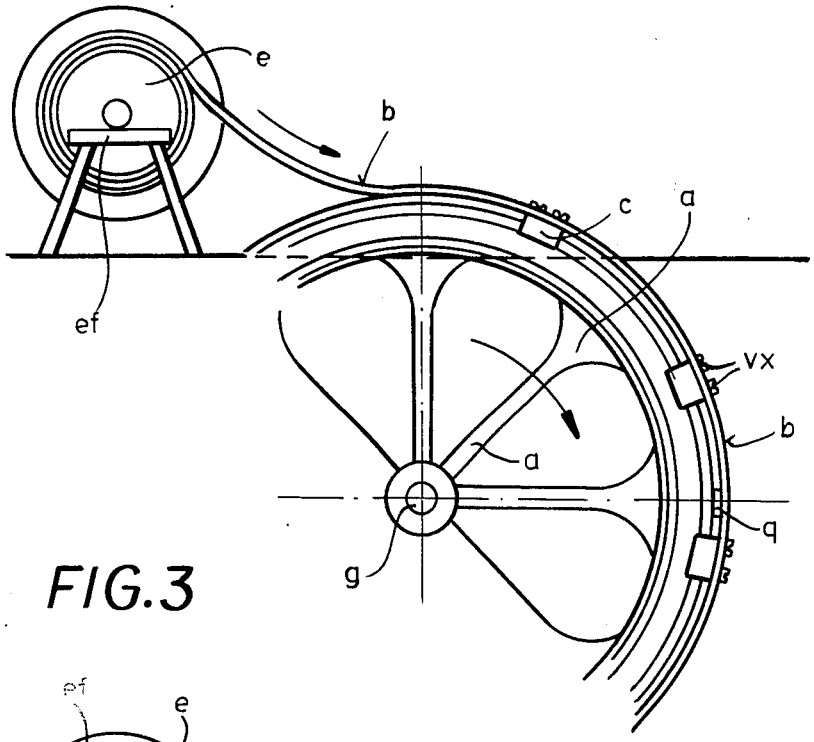
FIGS. 3–6 are schematic side elevational views and details of a part of the apparatus of FIG. 1 in operation showing various stages in the application and attachment of the metal wall.

By slowly rotating the drum a the metal band b is placed on the drum periphery and clamped to the drum a at the provided positions on both band edges cx by the clamping members c (FIG.3).

Figure 4:
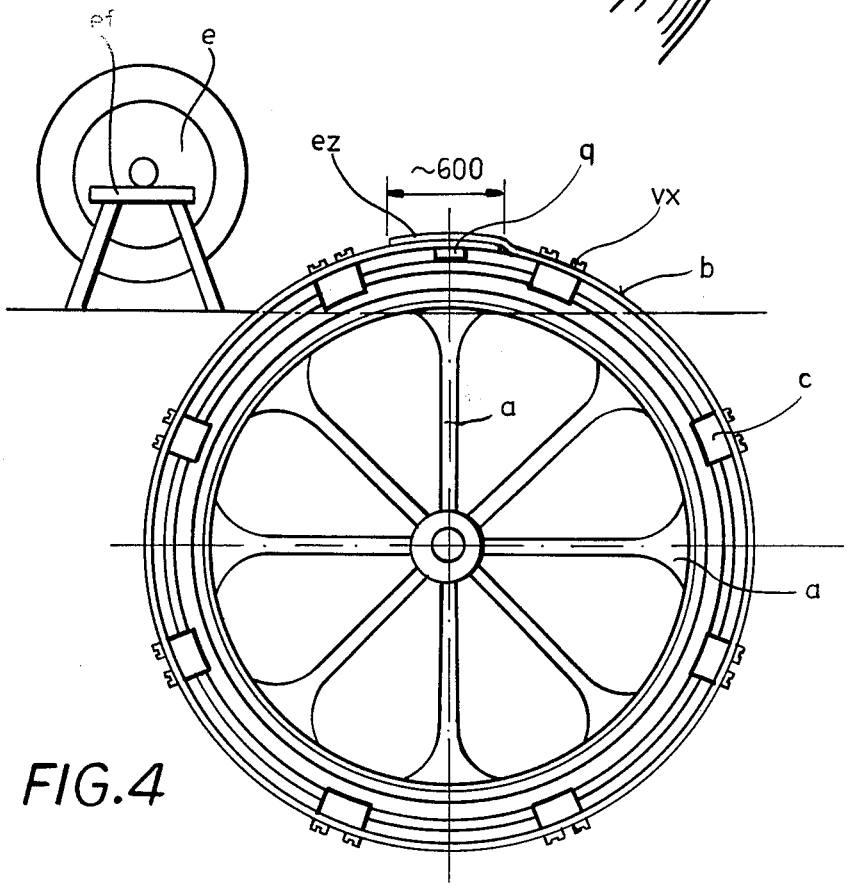

Thus in a stepwise process the entire band b is wound on the drum a by further rotation of the drum a and by screwing on the clamping members c. Finally both ends ez of the cut band b overlap about 600 mm (FIG. 4).

Figure 5A:
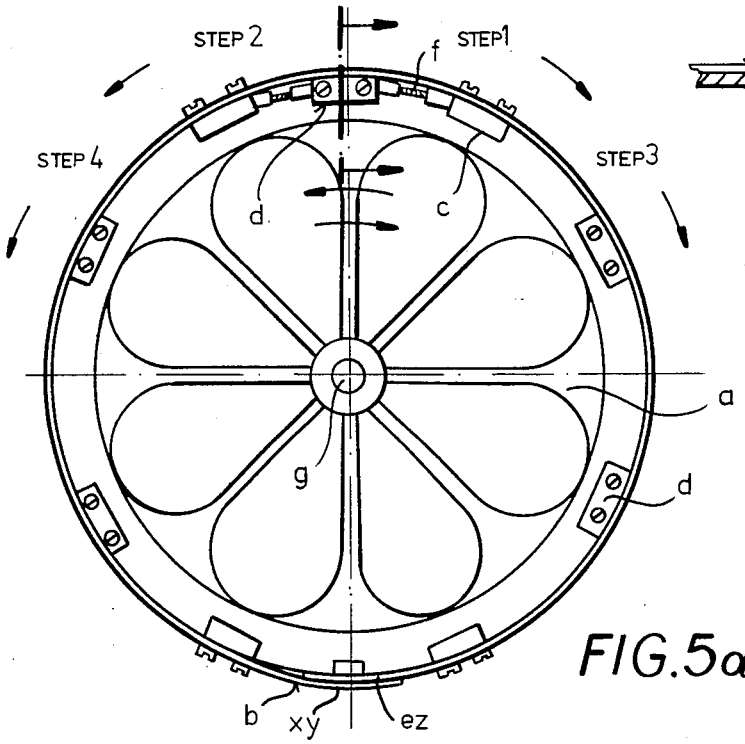
Figure 5A:
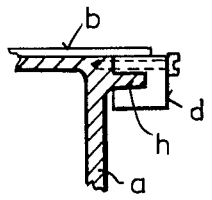
Figure 6:
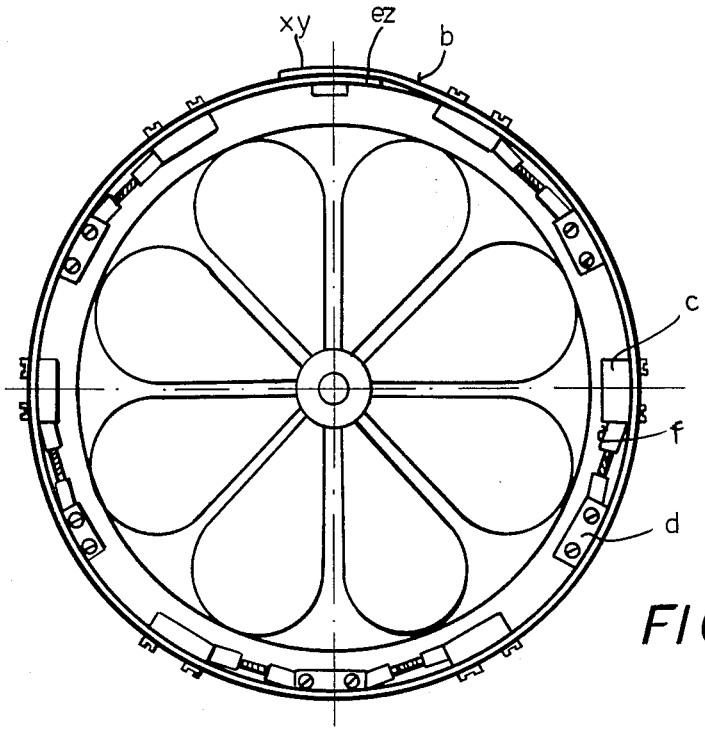

The actual clamping process must begin on the drum side lying diametrically opposing the position of overlap xy (FIGS. 5 and 6). For this purpose the initial clamping of the band b is disengaged and the position of overlap xy is rotated to the bottom of the apparatus.

The clamping of the band b begins with the clamping components at the top of drum a. Each of the clamping members c, d attached to the band (FIG. 5*a*), which are positioned at the top, are screwed to the left and right shoulder of the drum.

Figure 5B:
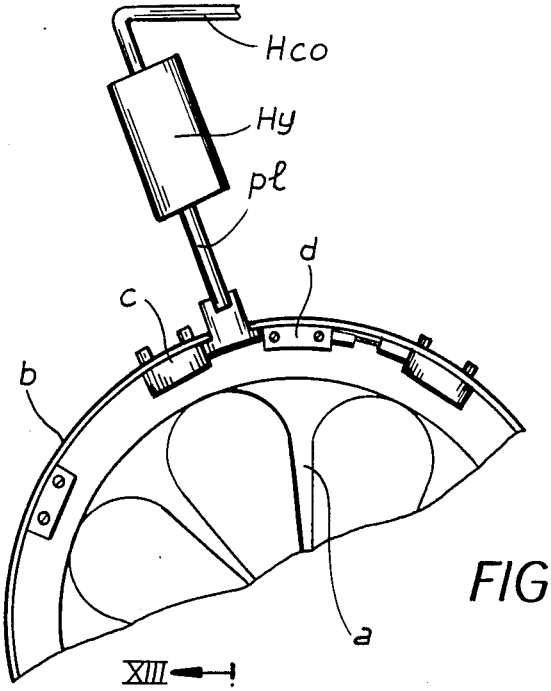
Figure 14:
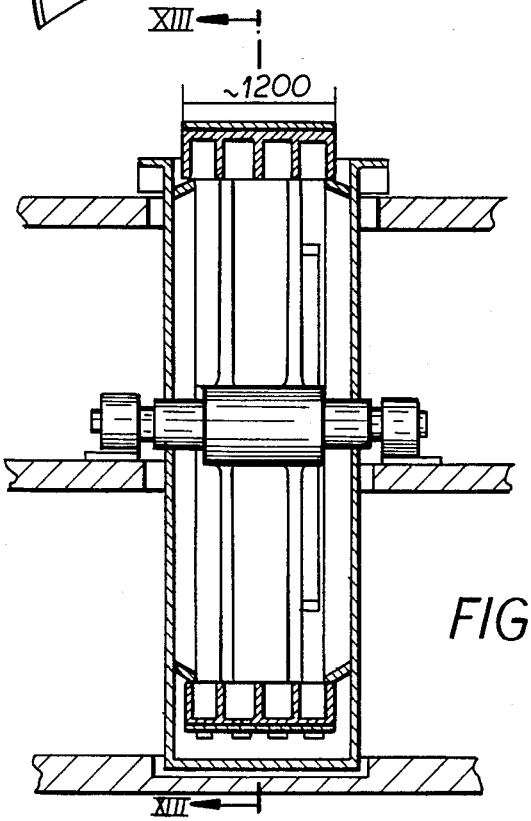
FIG. 14 is a cross sectional view of the apparatus of FIG. 13 taken along the section line XIV–XIV of FIG. 13.

The portion of the band b in this region on both sides of the drum is tensioned by a hydraulic pres Hy between the clamping member d, which holds the band b fast to the drum a, and the adjacent clamping member c screwed fast to the band b and is later held in this tensioned condition with a mechanical screw shackle f, which replaces the hydraulic press Hy between the clamping members c, d (FIG. 5*b*). Thus the region of the band b shown in FIG. 5*a* (position 1) is clamped firmly in place, i.e. the newly established tension is maintained.

In the next step the band b is tensioned in the counter clockwise direction (as indicated by the arrow labelled step 2).

Then the tensioning step (3) is again in the clockwise direction, while the next tensioning step at 4 is in the opposing counter clockwise direction.

The hydraulic press Hy is always fastened between the clamping member d screwed to the drum a and the clamping member c attached to the band edge cx and after providing the clamping force on that portion of the band b is replaced by the screw shackle f.

Thus the process continues to the final clamping step at overlapping of the ends ez of the band b.

All these tensioning steps are performed at normal room temperature.

Because of differences in the thermal expansion coefficient of band b and drum a a suitably high compression should be applied at room temperature so that in case the working temperature is higher the band b remains seated reliably and firmly on the drum a.

For example so that a high quality steel band b with a thermal expansion coefficient of about $16.10^{-6}$ m/m° C. at a working temperature of 40° C. may remain under a tension force of 3 kp/mm$^2$ against an iron drum a with a thermal expansion coefficient of about $11.10^{-6}$ m/m° C., one must apply a tension force of about 9 kp/mm$^2$ at room temperature in the described tensioning process.

In practice one can avoid the necessity of such a high clamping force by bringing the entire system to a temperature which is close to the working temperature. Then only a clamping force of 3 kp/mm$^2$ is applied by the previously described clamping system, which is easily controlled.

This hydraulic mounting-clamping system has the advantage that the clamping force can be applied controllably.

The follow up clamping process is described in the following section and is carried out at higher temperature.

For further increase of the band tension attained at normal room temperatures the drum a and with it also the band b on it are brought close to working temperature and the same process, as described starting from the first step (1) in the previous section, is repeated.

To cut both overlapping ends of the metal band clamped at the working temperature the rail 1 with a recess m for release of the cutting disk t is inserted in the groove 8 of the drum a.

The cutting of this groove 8 can be avoided—during manufacture of the drum—by providing a thin supporting band for protection of the surface of the casting drum a which is laid between the casting drum a and the band b in the vicinity of the cutting.

The band b is held on both sides at the place where it is to be cut and cut with a cutting wheel t moving linearly on its own guide member (FIG.7).

Figure 8:
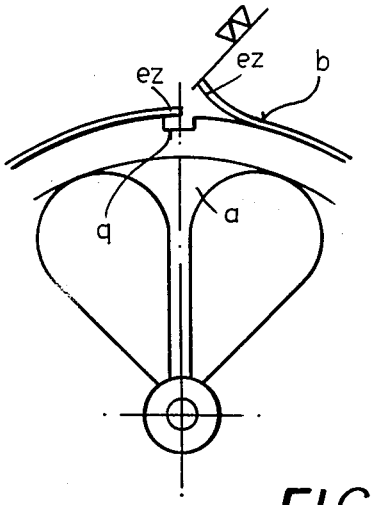
FIG. 8 is a cutaway side elevational view showing a part of the apparatus of FIG. 1 in operation during positioning of the edges of the metal shell prior to welding.

The surface of the band b is ground about 10 mm on both sides of the cut made by the disk cutter t to remove the oxide layer and to smooth the ends of the band (FIG.8).

For a continuous weld it is desirable that both band ends ez lie against each other. After the cutting however a gap amounting to a little more than the cutter thickness arises.

The closing of the gap formed by cutting the band is achieved by heating the drum and the band to a higher temperature and performing an additional "follow up clamping" of the band.

Figure 9:
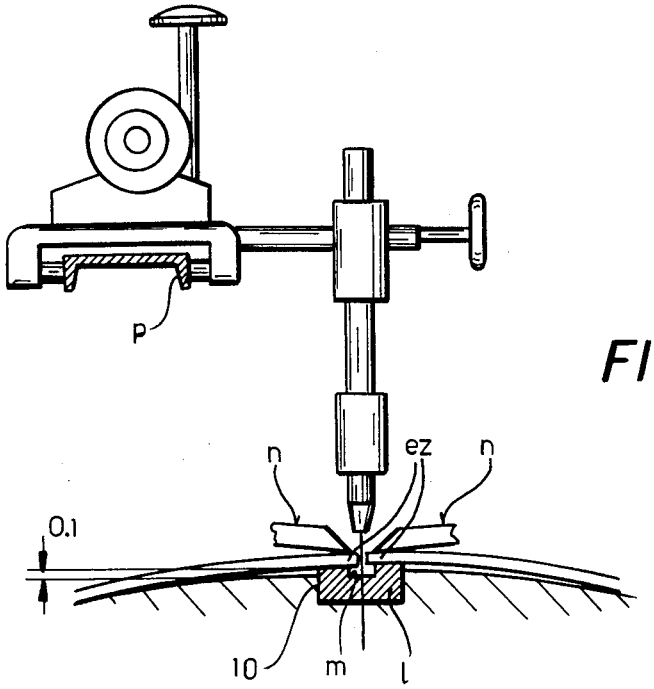
FIG. 9 is a side view showing the welding of the metal shell in the apparatus of FIG. 1.

The continuous weld is made by the TIG, Plasma or some other suitable welding process for stainless steel. To conduct away the heat generated by the welding process the copper rail l provided with the weld groove m is mounted in the groove q. This copper rail l projects about 1/10 mm above the surface of the drum. Should no groove q be cut, a suitable thin supporting band is inserted between band b and drum a (FIG.9).

Clamping flaps n press both ends of the band close to each other on the copper rail l. The welding occurs within precise welding parameters under control of an electric motor driven burner guide member p.

After the welding all clamping members c, d and screw shackles f are removed. The band b rests under tension upon the drum a. To form a proper weld bead n with penetration on both sides of the weld bead n the supporting band extends about 1/10 mm beyond the drum radius, likewise about 1/10 mm at the joint.

Thus the radius of the drum can be kept exactly the same in the vicinity of the weld seam (FIG. 10). By mechanical processes, for example by grinding and subsequently polishing or burnishing, the surface of the welded zone is made flush with the adjoining surfaces of the band.

Figure 23:
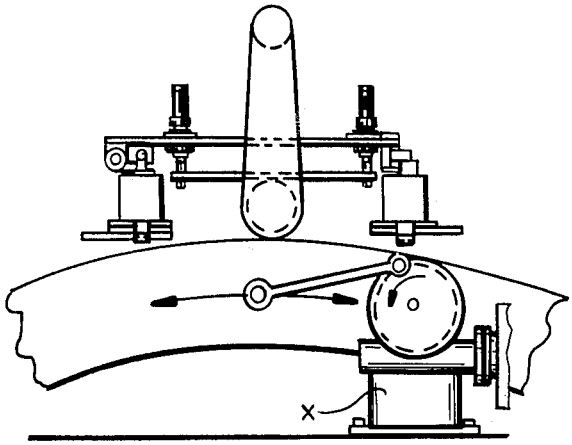
Figure 24:
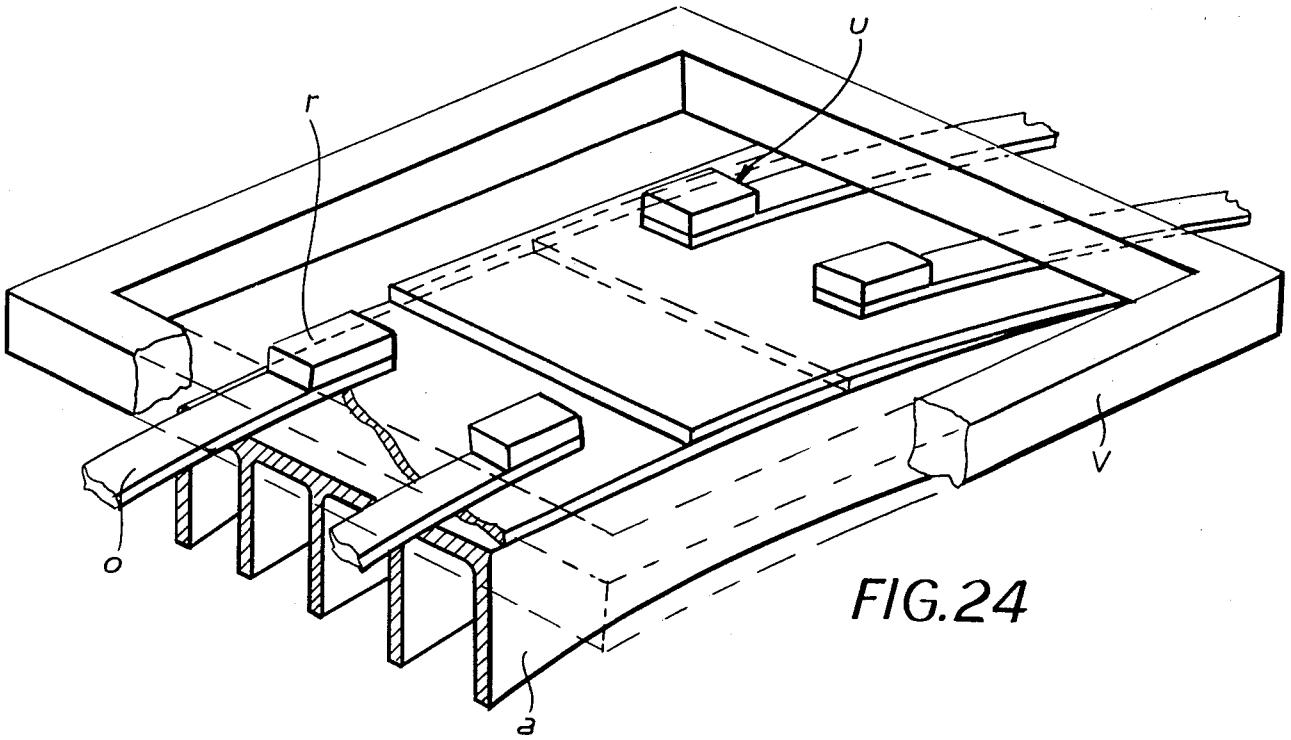
FIGS. 24 and 25 are enlarged perspective and cross sectional views of a part of the apparatus of FIG. 13 showing the action of the forces during clamping.
Figure 25:
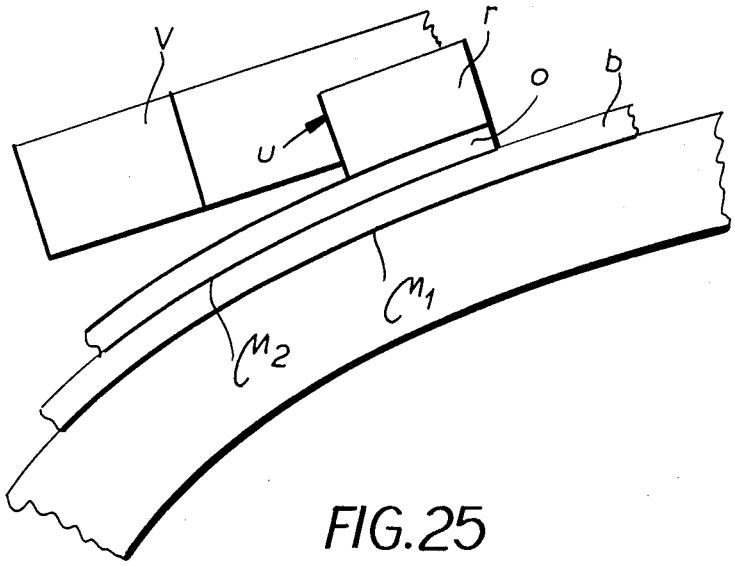

In cases where the drum a has no suitable reversing drive, it can be moved back and forth for grinding of the weld seam by a crank drive. This essentially shortens the working time (FIG.23).

Then the trimming of the band b occurs, that is, the overlying edges cx of the band are cut away by a cutting disk, cutter or rotating bit or chisel and the band edges deburred. In cases where the overlying band edges are no trouble the trimming can be omitted.

My invention is not limited to the shown embodiments. The drum or wheel, whose peripheral surface serves as the working surface, can also be rotated by the band. Instead of a guiding rim or projection grooves can also guide the clamping members. For attaching the clamping members instead of screws an adhesive or clamps can be used. Instead of a hydraulic clamping mechanism also a wedge or a threaded spindle mechanism can be used.

When the plate proportions or the construction characteristics of the casting drum a (and/or casting wheel) does not allow the band b to be put under the required clamping force by the clamping plates d, c and the screw shackle members f associated with it, this can be done by a clamping belt s.

This as can be seen from FIGS. 13–25 instead of the clamping members on the side of the drum a circumferential clamping belt o is used. It is wound with the metal band b around the drum a. Then when it is put under tension this tension clamps the band b. It is required that the friction coefficient $n_1$ between the metal band b and the drum a is smaller than the friction coefficient $n_2$ between the clamping belt and the metal band. This can occur by suitable choice of materials, by increasing the friction, and by avoiding coatings or intermediate layers that decrease the friction.

The process is then as follows:

Simultaneously the clamping belt o and the metal band b are unwound from the travelling spool which is supported on bases j and e with their ends lying on the drum a and attached with clamps kl which are screwed to the sides of the drum a. Thus spring loaded pressing bodies (FIG. 17) press the clamping belt o and the metal band b against the drum a. On further rotation of the drum a additional clamps kl are put in position until the periphery is covered. Instead of clamps kl pressin rollers at appropriate fixed supports can be used.

Figure 18:
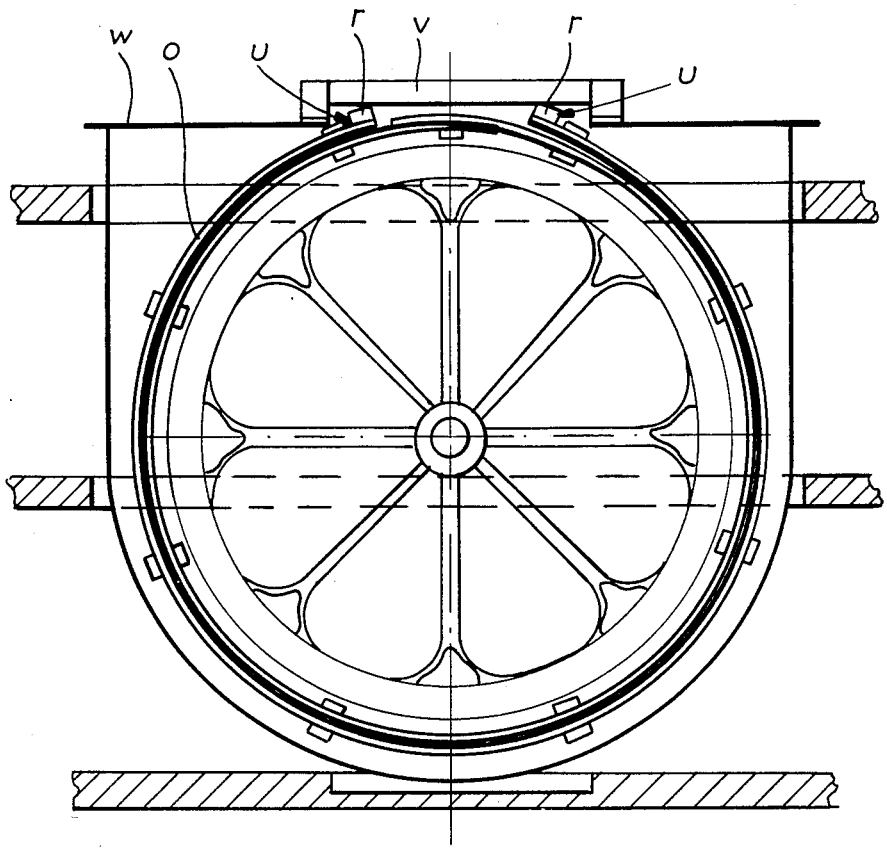
FIG. 18 is a side view of the apparatus of FIG. 13 showing the clamping frame for the clamping belt in place.
Figure 19:
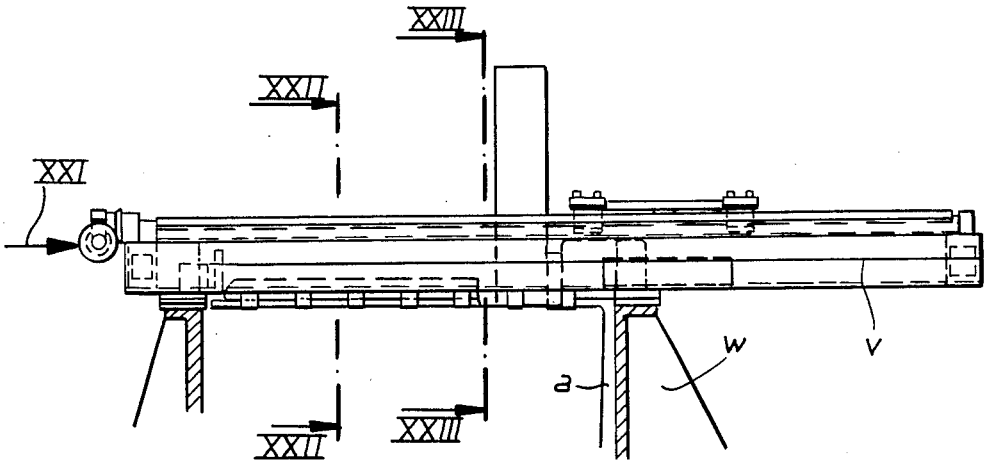
FIGS. 19 and 20 show elevational and plan views of the clamping frame of the apparatus of FIG. 13.
Figure 20:
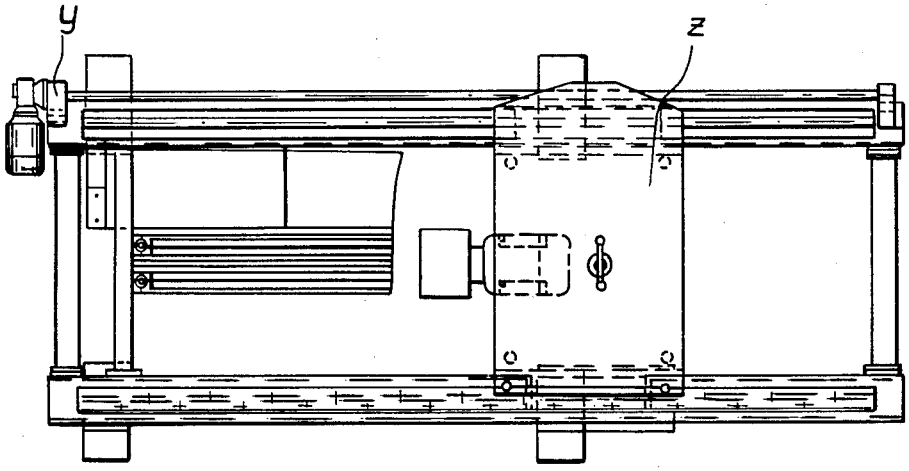
Figure 21:
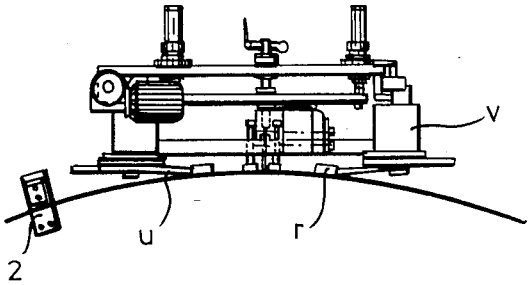
FIGS. 21, 22 and 23 are a side view and two cross sectional views of the clamping frame of FIG. 19 respectively.
Figure 22:
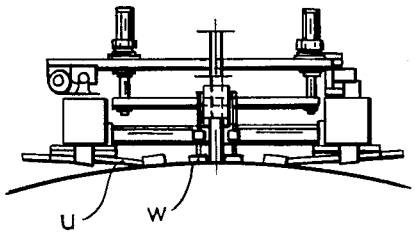

Then a clamping frame v is put over the overlapping ends and the end pieces of the clamping belt to apply the tension to the clamping belt o and the metal band b (FIG. 18). The clamping frame v, which rests on the frame w of the casting machine, has also a working carriage and a sliding drive for the tool, such as a cutter, welder or grinder (FIGS. 21–23). For motion of the casting drum a also a crank drive x can also be employed.

By finishing the joint or the product I mean grinding, polishing and/or burnishing the joint where the weld seam is located to make the surface of the circumference of the thin metal shell b endlessly smooth and continuous.

I claim:

1. A process for covering the periphery of a cylindrical metal drum with a thin metal shell which comprises:

unrolling a metal band onto said drum;

pressing said metal band continuously onto said drum until said b and surrounds said drum and ends of said metal band overlap;

clamping said metal band to said drum under tension by wrapping a clamping belt around said metal band;

with said band clamped under tension cutting said metal bands to length;

welding ends of said band together; and finishing the resulting metal band.

2. A process for covering the periphery of a cylindrical metal drum with a thin metal shell which comprisies:

unrolling a metal band onto said drum;

pressing said metal band continuously onto said drum until said band surrounds said drum and ends of said metal band overlaps;

clamping said metal band to said drum under tension;

with said band clamped under tension cutting said metals band to length;

welding ends of said band together; and finishing the resulting metal band;

said metal band which is unrolled onto said drum being attached to each edge of the cirmcumference of said drum continuously with clamping members until said ends of said metal band overlap, then proceeding from the side opposite where said ends of said metal band overlap a plurality of pairs of clamping plates are attached stepwise to said drum and said metal band and each of said pairs of clamping plates are pushed apart by a clamping mechanism mounted successively between each of said pairs of claimping plates, whereby portions of said metal band lying between said pairs of clamping plates is brought under a predetermined tension force stepwise until the position where said ends of said metal band overlap is reached, and then said ends of said metal band which overlap are cut through and after finishing said ends and after a follow up clamping to close a gap formed between said ends of said metal band, welding said ends of said metal band together and subsequently finishing.

3. The process according to claim 2 wherein said position where said ends overlap is placed at the bottom of said drum and before said follow up clamping said ends of said metal band are released.

4. The process according to claim 2 wherein said clamping mechanism is hydraulic and after operation of said clamping mechanism said clamping mechanism is replaced by a screw shackle.

5. The process according to claim 2 wherein said clamping is conducted stepwise alternating between both sides of said drum.

6. The process according to claim 2 wherein said ends of said metal band are positioned on top of said drum during said working and said welding.

7. The process according to claim 2 wherein said clamping and said follow up clamping are conducted at a raised temperature above ambient temperature.

8. The process according to claim 2 wherein said raised temperature is the operating temperature.

9. The process according to claim 2 wherein said welding occurs by a TIG process with an electric motor driven torch guide member.

10. The process according to claim 2, further comprising removing said clamping members and said clamping plates and trimming the edges of said metal band.

11. A process for covering the periphery of a cylindrical metal drum with a thin metal shell which comprises:

unrolling a metal band onto said drum;

pressing said metal band continuous onto said drum until said band surrounds said drum and ends of said metal band overlap;

clamping said metal band to said drum under tension;

with said band clamped under tension cutting said metal band to length;

welding ends of said band together; and finishing the resulting metal band;

a clamping belt being unrolled with said metal band, wrapped around said metal band on said drum under tension, and clamps said metal band to said drum by friction.

12. A process according to claim 11 wherein the clamping force is provided by a clamping frame which simultaneously can act as a support for a clamping member and a tool such as a cutter, a grinder, a welding torch or the like.

13. A process according to claim 12 wherein said metal band is pressed by a roller to said drum.

14. A process according to claim 13 wherein a crank drive whose drive engages said drum provides the rotations required of said drum.

15. An apparatus for covering the periphery of a cylindrical metal drum with a thin metal shell comprising a pivotal support for mounting said drum rotatably on a horizontal axis, a groove in said drum at the position where said welding occurs, a rail with a recess for release of a cutting tool and for a weld seam held in said groove, a plurality of pairs of clamping members mounted on a shoulder rim of said drum attachable by screws to said drum and said band, and a clamping mechanism temporarily connected between each of said clamping members of said pairs of clamping members to provide longitudinal tension to said metal band which is replaceable by a screw shackle.

16. An apparatus according to claim 15 wherein said rail projects above said circumference of said drum to permit working of the weld bead of said weld seam and said rail with said recess for said weld seam to provide a smooth surface flush with the surrounding surfaces of said metal band.

17. An apparatus according to claim 16 wherein said rail is composed of copper metal.

18. A process for covering the periphery of a cylindrical metal drum with a thin metal shell comprising:

unrolling a metal band onto said drum and pressing said metal band continuously onto said drum until said metal band covers the periphery of said drum and the ends of said metal band overlap;

clamping said metal band to said drum;

heating said drum and said band to a temperature above ambient temperature;

cutting said metal band to length to form a smooth shell on said drum;

performing a follow up clamping of said metal band to decrease the gap between the cut ends of said metal band;

welding said cut ends of said metal band using a welding torch with an electric motor driven torch guide member; and finishing the weld seam formed by said welding including grinding and polishing said weld seam.

19. A process according to claim 18 wherein said clamping is performed by attaching a plurality of clamping plates stepwise to said drum and said metal band, pushing apart each of said pairs of said clamping plates temporarily by a clamping device to load said metal band tensionally, and replacing said clamping device by a screw shackle.

20. A process according to claim 18 wherein said clamping is performed by unrolling a clamping belt with said metal band, wrapping said clamping belt around said metal band and providing tension to said clamping belt using a clamping frame to clamp said metal band to said drum by friction.

* * * * *